US007058571B2

(12) United States Patent
Tsushima et al.

(10) Patent No.: US 7,058,571 B2
(45) Date of Patent: Jun. 6, 2006

(54) AUDIO DECODING APPARATUS AND METHOD FOR BAND EXPANSION WITH ALIASING SUPPRESSION

(75) Inventors: Mineo Tsushima, Osaka (JP); Naoya Tanaka, Osaka (JP); Takeshi Norimatsu, Hyogo (JP); Kok Seng Chong, Singapore (SG); Kim Hann Kuah, Singapore (SG); Sua Hong Neo, Singapore (SG); Toshiyuki Nomura, Tokyo (JP); Osamu Shimada, Tokyo (JP); Yuichiro Takamizawa, Tokyo (JP); Masahiro Serizawa, Tokyo (JP)

(73) Assignees: Matsushita Electric Industrial Co., Ltd., Osaka (JP); NEC Corporation, Tokyo (JP)

( * ) Notice: Subject to any disclaimer, the term of this patent is extended or adjusted under 35 U.S.C. 154(b) by 0 days.

(21) Appl. No.: 10/491,894

(22) PCT Filed: Jul. 30, 2003

(86) PCT No.: PCT/JP03/09646

§ 371 (c)(1),
(2), (4) Date: Oct. 18, 2004

(87) PCT Pub. No.: WO2004/013841

PCT Pub. Date: Feb. 12, 2004

(65) Prior Publication Data

US 2005/0080621 A1 Apr. 14, 2005

(30) Foreign Application Priority Data

Aug. 1, 2002 (JP) ..... 2002-225068

(51) Int. Cl.
*G10L 21/02* (2006.01)

(52) U.S. Cl. ..... 704/225; 704/205; 704/228; 704/268; 704/501

(58) Field of Classification Search ..... None
See application file for complete search history.

(56) References Cited

U.S. PATENT DOCUMENTS

| | | | | |
|---|---|---|---|---|
| 4,691,292 | A * | 9/1987 | Rothweiler | 708/316 |
| 4,766,562 | A * | 8/1988 | Vary | 708/313 |
| 5,301,255 | A * | 4/1994 | Nagai et al. | 704/230 |
| 5,327,366 | A * | 7/1994 | Mau | 708/321 |
| 5,654,952 | A * | 8/1997 | Suzuki et al. | 369/59.16 |
| 6,539,355 | B1 * | 3/2003 | Omori et al. | 704/268 |
| 6,895,375 | B1 * | 5/2005 | Malah et al. | 704/219 |

FOREIGN PATENT DOCUMENTS

JP 7-210196 8/1995

(Continued)

OTHER PUBLICATIONS

"Digital Radio Mondiale (DRM); System Specification", ETSI TS 101 980 V1.1.1 (Sep. 2001), pp. 1-158.

(Continued)

*Primary Examiner*—Donald L. Storm
(74) *Attorney, Agent, or Firm*—Wenderoth, Lind & Ponack, L.L.P.

(57) ABSTRACT

A wideband, high quality audio signal is decoded with few calculations at a low bitrate. Unwanted spectrum components accompanying sinusoidal signal injection by a synthesis subband filter built with real-value operations are suppressed by inserting a suppression signal to subbands adjacent to the subband to which the sine wave is injected. This makes it possible to inject a desired sinusoid with few calculations.

13 Claims, 13 Drawing Sheets

FOREIGN PATENT DOCUMENTS

| | | |
|---|---|---|
| JP | 8-162964 | 6/1996 |
| JP | 11-109994 | 4/1999 |
| JP | 2000-68948 | 3/2000 |
| JP | 2001-521648 | 11/2001 |
| JP | 2002-55698 | 2/2002 |
| WO | 98/57436 | 12/1998 |
| WO | 02/056295 | 7/2002 |

OTHER PUBLICATIONS

Stefan Meltzer et al., "SBR enhanced audio codecs for digital broadcasting such as "Digital Radio Mondiale" (DRM)", Audio Engineering Society, Convention Paper 5559, presented at the 112th Convention, May 10-13, 2002, Munich, Germany, pp. 1-4.

Martin Dietz et al., "Spectral Band Replication, a novel approach in audio coding", Audio Engineering Society, Paper 5553, Presented at the 112th Convention, May 10-13, 2002, Munich, Germany.

Thomas Ziegler, "Enhancing mp3 with SBR: Features and Capabilities of the new mp3PRO Algorithm", Audio Engineering Society, Paper 5560, Presented at the 112th Convention, May 10-13, 2002, Munich, Germany.

* cited by examiner

Fig.6

| TIME \ BAND | K-1 | K | K+1 |
|---|---|---|---|
| 0 | (0,0) | (S,0) | (0,0) |
| 1 | (0,0) | (0,S) | (0,0) |
| 2 | (0,0) | (-S,0) | (0,0) |
| 3 | (0,0) | (0,-S) | (0,0) |

Fig. 7

| TIME \ BAND | K−1 | K | K+1 |
|---|---|---|---|
| 0 | 0 | S | 0 |
| 1 | 0 | 0 | 0 |
| 2 | 0 | -S | 0 |
| 3 | 0 | 0 | 0 |

Fig.8

| TIME \ BAND | K−1 | K | K+1 |
|---|---|---|---|
| 0 | 0 | S | 0 |
| 1 | Alpha*S | 0 | Beta*S |
| 2 | 0 | -S | 0 |
| 3 | Beta*S | 0 | Alpha*S |

Fig. 11

| TIME \ BAND | K−1 | K | K+1 |
|---|---|---|---|
| 0 | $(-1)^{k}*P*\sin(\delta)$ | $(-1)^{k}*S*\cos(\delta)$ | $(-1)^{k}*Q*-\sin(\delta)$ |
| 1 | $P*\cos(\delta)$ | $S*-\sin(\delta)$ | $Q*-\cos(\delta)$ |
| 2 | $(-1)^{k}*P*-\sin(\delta)$ | $(-1)^{k}*S*-\cos(\delta)$ | $(-1)^{k}*Q*\sin(\delta)$ |
| 3 | $P*-\cos(\delta)$ | $S*\sin(\delta)$ | $Q*\cos(\delta)$ |

AUDIO DECODING APPARATUS AND METHOD FOR BAND EXPANSION WITH ALIASING SUPPRESSION

TECHNICAL FIELD

The present invention relates to a decoding apparatus and decoding method for an audio bandwidth expansion system for generating a wideband audio signal from a narrowband audio signal by adding additional information containing little information, and relates to technology enabling this system to provide high audio quality playback with few calculations.

BACKGROUND ART

Many audio encoding technologies for encoding an audio signal to a small data size and then reproducing the audio signal from the coded bitstream are known. The international ISO/IEC 13818-7 (MPEG-2 AAC) standard in particular is known as a superior method enabling high audio quality playback with a small code size. This AAC coding method is also used in the more recent ISO/IEC 14496-3 (MPEG-4 Audio) system.

Audio coding methods such as AAC convert a discrete audio signal from the time domain to a signal in the frequency domain by sampling the time-domain signal at specific time intervals, splitting the converted frequency information into plural frequency bands, and then encoding the signal by quantizing each of the frequency bands based on an appropriate data distribution. For decoding, the frequency information is recreated from the code stream, and the playback sound is obtained by converting the frequency information to a time domain signal. If the amount of information supplied for encoding is small (such as in low bitrate encoding), the data size allocated to each of the segmented frequency bands in the coding process decreases, and some frequency bands may as a result contain no information. In this case the decoding process produces playback audio with no sound in the frequency component of the frequency band containing no information.

In general, because sensitivity to sound with a frequency above approximately 10 kHz is lower than to sound at lower frequencies, high frequency component data is generally dropped to provide narrowband audio playback if the audio coding scheme distributes information by a process based on human auditory perception.

If data is supplied at a bitrate of approximately 96 kbps, even the AAC method can code a 44.1 kHz stereo signal to an approximately 16 kHz band, but if data is encoded with data supplied at half this rate, i.e., 48 kbps, the bandwidth that can be quantified and coded while maintaining sound quality is reduced to at most approximately 10 kHz. In addition to being narrowband, playback sound coded with a low 48 Kbps bitrate also sounds cloudy.

A method enabling wideband playback by adding a small amount of additional information to a code stream for narrowband audio playback is described, for example, in the Digital Radio Mondiale (DRM) System Specification (ETSI TS 101 980) published by the European Telecommunication Standards Institute (ETSI). Similar technology known as SBR (spectral band replication) is described, for example, in AES (Audio Engineering Society) convention papers 5553, 5559, 5560 (112th Convention, 2002 May 10–13, Munich, Germany).

FIG. 2 is a schematic block diagram of an example of a decoder for band expansion using SBR. Input bitstream 206 is separated by the bitstream demultiplexer 201 into low frequency component information 207, high frequency component information 208, and sine wave-adding information 209. The low frequency component information 207 is, for example, information encoded using the MPEG-4 AAC or other coding method, and is decoded by the low-band decoder 202 whereby a time signal representing the low frequency component is generated. This time signal representing the low frequency component is separated into multiple (M) subbands by analysis filter bank 203 and input to high frequency signal generator 204.

The high frequency signal generator 204 compensates for the high frequency component lost due to bandwidth limiting by copying the low frequency subband signal representing the low frequency component to a high frequency subband. The high frequency component information 208 input to the high frequency signal generator 204 contains gain information for the compensated high frequency subband so that gain is adjusted for each generated high frequency subband.

An additional signal generator 211 generates injection signal 212 whereby a gain-controlled sine wave is added to each high frequency subband. The high frequency subband signal generated by the high frequency signal generator 204 is then input with the low frequency subband signal to the synthesis filter bank 205 for band synthesis, and output signal 210 is generated. The subband count on the synthesis filter bank side does not need to be the same as the number of subbands on the analysis filter bank side. For example, if in FIG. 2 N=2M, the sampling frequency of the output signal will be twice the sampling frequency of the time signal input to the analysis filter bank.

In this configuration the information contained in the high frequency component information 208 or sine wave-adding information 209 relates only to gain control, and the amount of required information is therefore very small compared with the low frequency component information 207, which also contains spectral information. This method is therefore suited to encoding a wideband signal at a low bitrate.

The synthesis filter bank 205 in FIG. 2 is composed of filters that take both real number input and imaginary number input for each subband, and perform a-complex-valued calculation.

The decoder configured as above for band expansion has two filters, the analysis filter bank and synthesis filter bank, performing complex-valued calculations, and decoding requires many calculations. A problem when the decoder is built for LSI devices, for example, is that power consumption increases and the playback time that is possible with a given power supply capacity decreases. Because the signals that we hear in the output from the synthesis filter bank are real-number signals, the synthesis filter bank may be configured with real number filter banks in order to reduce the calculations. While this reduces the number of calculations, if a sine wave is added using the same method as when the synthesis filter bank performs complex-valued calculations, a pure sine wave is not actually added and the intended result is not achieved in the reproduced audio.

The present invention is therefore directed to solving these problems of the prior art, and provides a decoding apparatus and method for a band expansion system operating with few calculations by using a real-valued calculation filter bank whereby the intended audio playback is achieved by adding slight change to an added sine wave generation signal such as would be inserted to a complex-valued calculation filter bank.

SUMMARY OF THE INVENTION

The present invention provides an audio decoding apparatus for decoding an audio signal from a bitstream, the bitstream containing encoded information about a narrowband audio signal and additional information for expanding the narrowband signal to a wideband signal, and the additional information containing high frequency component information denoting a feature of a higher frequency band than the band of the encoded information, and sinusoid-adding information denoting a sinusoidal signal added to a specific frequency band, the audio decoding apparatus comprising:

a bitstream demultiplexer for demultiplexing the encoded information and additional information from the bitstream;

a decoding means for decoding a narrowband audio signal from the demultiplexed encoded information;

an analysis subband filter for separating the narrowband audio signal into multiple first subband signals;

a high frequency signal generator for generating multiple second subband signals in a higher frequency band than the band of the encoded information from at least one first subband signal and high frequency component information from the demultiplexed additional information;

a sinusoidal signal addition means for adding a sinusoidal signal to a specific subband of the multiple second subband signals based on the sinusoid-adding information of the demultiplexed additional information;

a compensation signal generator for generating, based on the phase characteristic and amplitude characteristic of the sinusoidal signal, a compensation signal for suppressing aliasing component signals produced in subbands near a specific subband as a result of adding a sinusoidal signal; and a real-valued calculation synthesis subband filter for combining the first subband signals and second subband signals to obtain a wideband audio signal.

Thus comprised, high quality audio playback can be achieved at a low bitrate using few calculations.

BRIEF DESCRIPTION OF THE DRAWINGS

FIG. 6 shows examples of the injection signals generated by the additional signal generator shown in FIG. 3;

FIG. 7 shows only the real-number part of the injection signals generated by the additional signal generator shown in FIG. 3;

FIG. 8 shows examples of injection signals and compensation signals generated by the additional signal generator and compensation signal generator shown in FIG. 4;

FIG. 11 shows another example of the injection signal and compensation signal shown by way of example in FIG. 8;

DETAILED DESCRIPTION OF THE INVENTION

Figure 13:
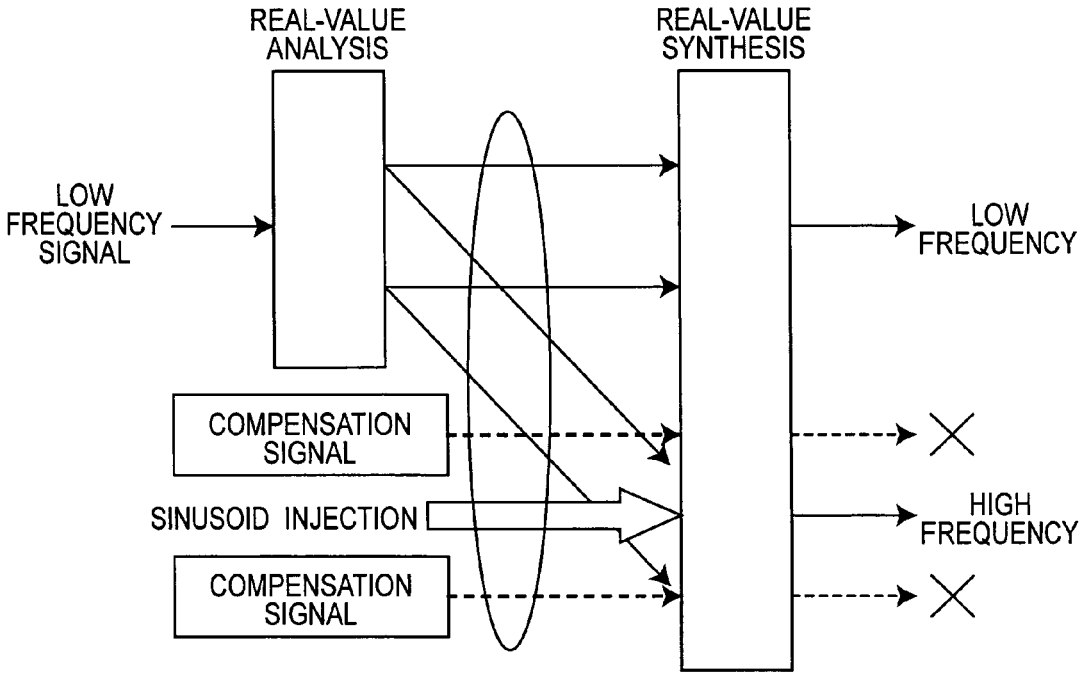
FIG. 13 is a block diagram showing the principle of the present invention.

FIG. 13 is a block diagram showing the principle of the present invention. Music and other audio signals contain a low frequency band component and a high frequency band component. Encoded audio signal information is carried by the low frequency band component, and tone information (sinusoidal information) and gain information are carried by the high frequency band component. The receiver decodes the audio signal from the low frequency band component, but for the high frequency band component, copies and processes the low frequency band component using the tone information and gain information to synthesize a pseudo-audio signal. Phase information and amplitude information are needed to synthesize this pseudo-audio signal, and synthesis thus requires a complex-valued calculation. Because complex-valued calculations require operations on both the real number and imaginary number parts, the calculation process is complex and time-consuming. To simplify this calculation process the present invention operates using only the real number part. However, if the calculations are done using only the real-value part for certain subbands, noise signals appear in the adjacent higher and lower subbands. A compensation signal for cancelling these noise signals is generated using the phase information, amplitude information, and timing information contained in the tone information.

An audio decoding apparatus and method according to a preferred embodiment of the present invention are described below with reference to the accompanying figures.

(Embodiment 1)

Figure 1:
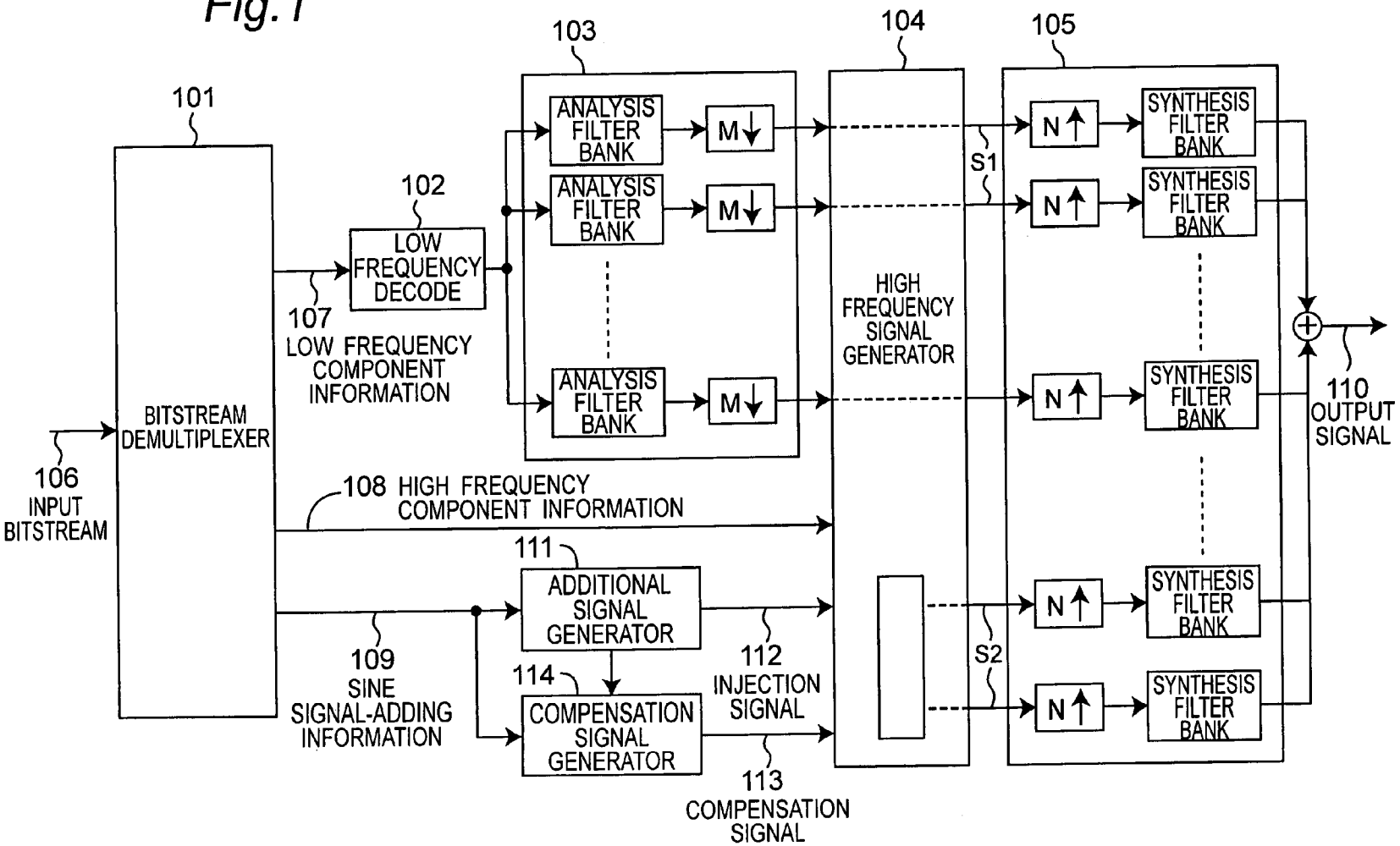
FIG. 1 is a schematic block diagram showing an example of an audio decoding apparatus according to the present invention.
Figure 2:
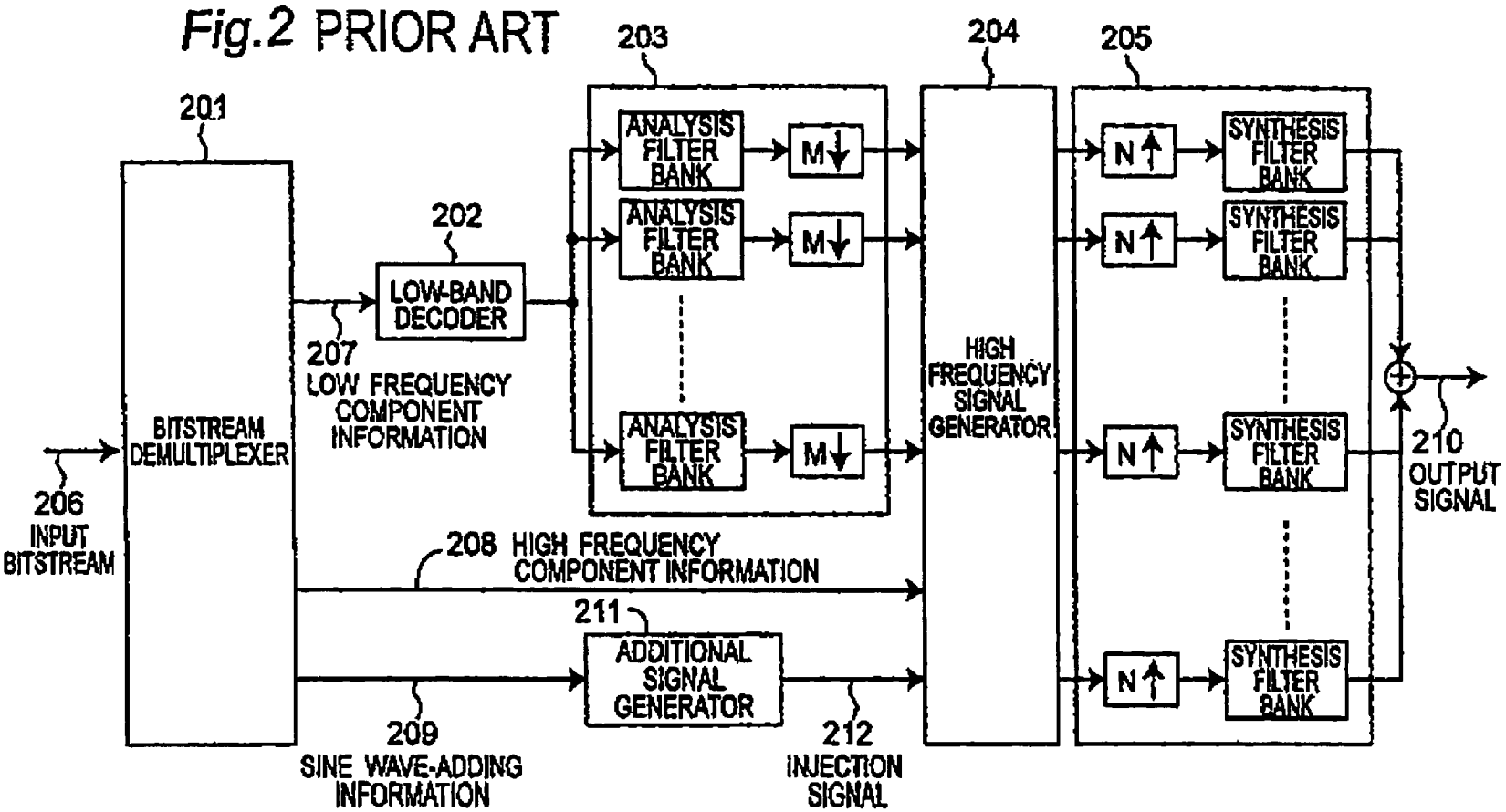
Fig.2 PRIOR ART
FIG. 2 shows an example of the configuration of a prior art audio decoding apparatus.

FIG. 1 is a schematic diagram showing a decoding apparatus performing bandwidth expansion by means of spectral band replication (SBR) based on a first embodiment of the present invention.

The input bitstream 106 is demultiplexed by the bitstream demultiplexer 101 into low frequency component information 107, high frequency component information 108, and sine signal-adding information 109. The low frequency component information 107 is information that is encoded using, for example, the MPEG-4 AAC coding method, is decoded by the low frequency decoder 102, and a time signal representing the low frequency component is generated. The resulting time signal representing the low frequency component is then divided into multiple (M) subbands by the analysis filter bank 103, and input to the bandwidth expansion means (high frequency signal generator) 104. The high frequency signal generator 104 copies the low frequency subband signal representing the low frequency component to a high frequency subband to compensate for the high frequency component lost by the bandwidth limit. The high frequency component information 108 input to the high frequency signal generator 104 contains gain information for the high frequency subband to be generated, and the gain is adjusted for each generated high frequency subband.

Additional signal generator 111 produces injection signal 112 so that a gain-controlled sine wave is added to each high frequency subband according to the sine signal-adding information (also called tone information) 109. The high frequency subband signals generated by the high frequency signal generator 104 are input with the low frequency subband signals to the synthesis filter bank 105 for band synthesis, resulting in output signal 110. The number of subbands on the synthesis filter bank does not need to match the number of subbands on the analysis filter bank side. For example, if in FIG. 1 N=2M, the sampling frequency of the output signal will be twice the sampling frequency of the time signal input to the analysis filter bank.

The input bitstream 106 contains narrowband encoded information for the audio signal (i.e., low frequency component information 107) and additional information for expanding this narrowband signal to a wideband signal (i.e., high frequency component information 108 and sine signal-adding information 109).

The synthesis filter bank 105 of the decoding apparatus shown in FIG. 1 is composed of real-valued calculation filters. It will also be obvious that a complex-valued calculation filter that can perform real-valued calculations could be used.

The decoding apparatus shown in FIG. 1 also has a compensation signal generator 114 for generating compensation signal 113 for compensating the difference resulting from sinusoidal signal addition.

The input bitstream 106 is demultiplexed by the bitstream demultiplexer 101 into low frequency component information 107, high frequency component information 108, and sine signal-adding information 109.

The low frequency component information 107 is, for example, an MPEG-4 AAC, MPEG-1 Audio, or MPEG-2 Audio encoded bitstream that is decoded by a low frequency decoder 102 having a compatible decoding function, and a time signal representing the low frequency component is generated. The resulting time signal representing the low frequency component is then divided into multiple (M) first subbands S1 by the analysis filter bank 103, and input to the high frequency signal generator 104. The analysis filter bank 103 and synthesis filter bank 105 described below are built from a polyphase filter bank or MDCT converter. Band splitting filter banks are known to one with ordinary skill in the related art.

The first subband signals S1 for the low frequency signal component from the analysis filter bank 103 are output directly by the high frequency signal generator 104 and also sent to the synthesis part. The high frequency signal generation part of the high frequency signal generator 104 receives the first subband signals S1 and using high frequency component information 108, injection signal 112, and compensation signal 113 generates multiple second subband signals S2. The second subband signals S2 are in a higher frequency band than the first subband signals S1. The high frequency component information 108 includes information indicating which one of the first subband signals S1 is to be copied, and which one of the second subband signals S2 is to be generated, and gain control information indicating how much the copied first subband signal S1 should be amplified.

If there is no sine signal-adding information 109 or no signal actually generated using the sine signal-adding information 109, the synthesis filter bank 105 with N (where N is greater or equal to M) subband synthesis filters combines the expanded-bandwidth subband signals output from the high frequency signal generator 104 and the low frequency signal component from the analysis filter bank 103 to produce wideband output signal 110.

In this first embodiment of the invention the synthesis filter bank 105 is a real-value calculation filter bank. That is, the synthesis filter bank 105 does not use imaginary number input, only has a real number input part, and uses filters that perform real-valued calculations. This synthesis filter bank 105 is therefore simpler and operates faster than a filter that operates with complex-valued calculations.

If there is sine signal-adding information 109, the sine signal-adding information 109 is input to the additional signal generator 111 whereby injection signal 112 is generated, and added to the output signal from high frequency signal generator 104. The sine signal-adding information 109 is also input to the compensation signal generator 114 whereby compensation signal 113 is produced, and similarly added to the output signal of high frequency signal generator 104.

The output signal from high frequency signal generator 104 is input to synthesis filter bank 105. The synthesis filter bank 105 outputs output signal 110 regardless of whether there is an added signal based on sine signal-adding information 109.

Generating the injection signal 112 and compensation signal 113 based on sine signal-adding information 109 is described in further detail below using FIG. 3 and FIG. 4.

Figure 3:
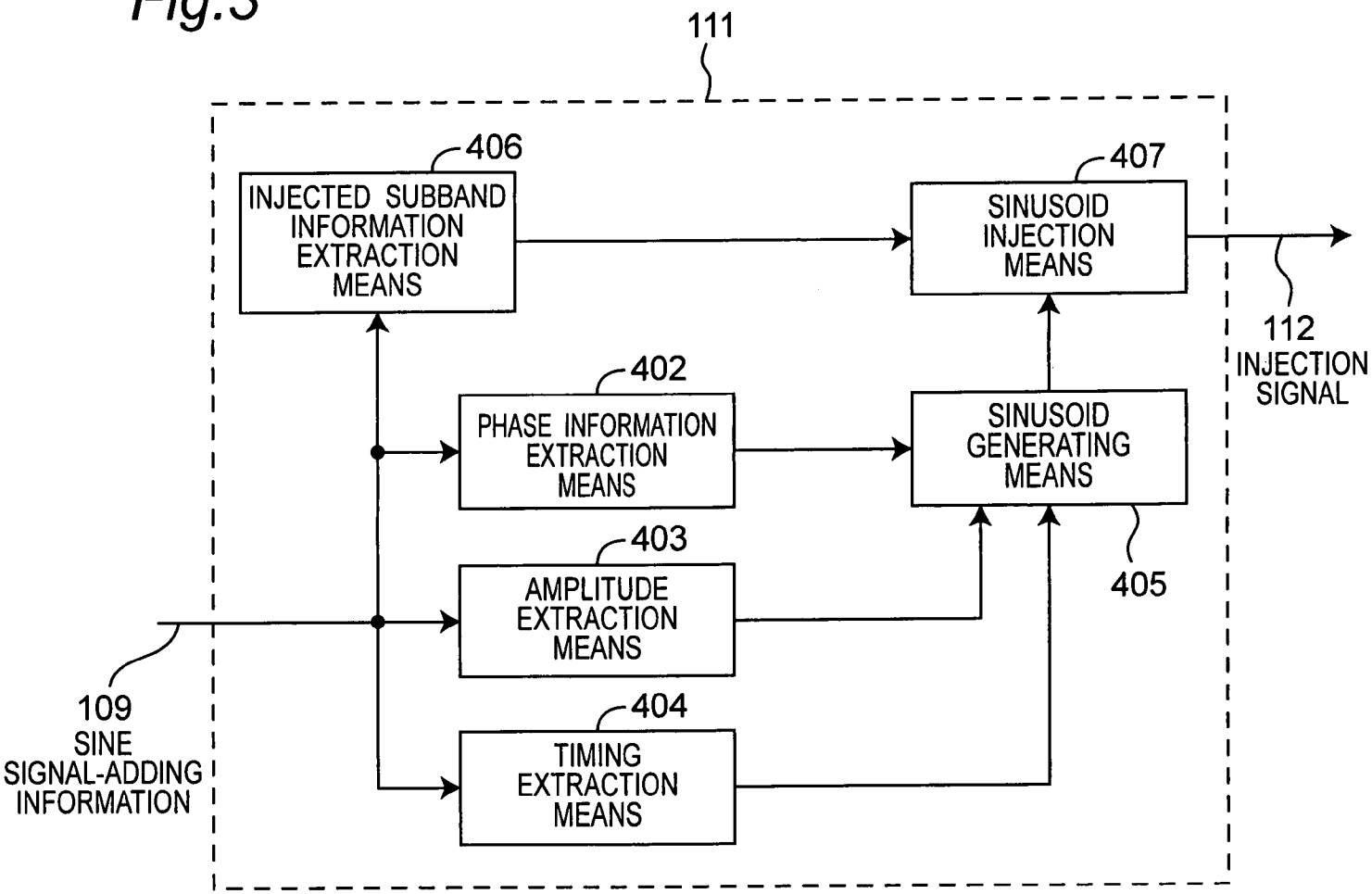
FIG. 3 shows an example of an additional signal generator for describing the principle of the present invention.
Figure 4:
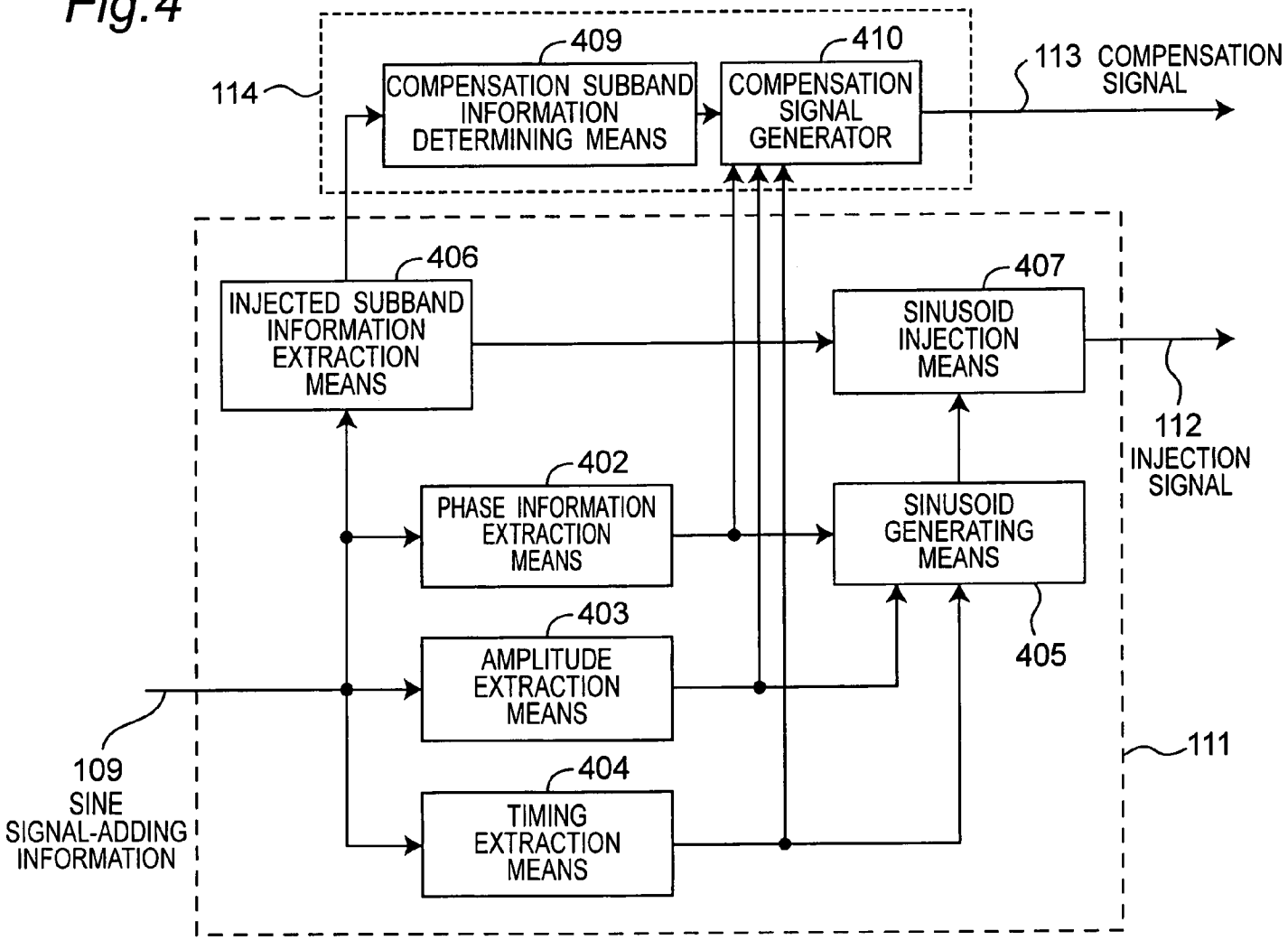
FIG. 4 shows an example of an additional signal generator in a first embodiment of the present invention.

FIG. 3 shows the additional signal generator 111 used in the audio decoding method describing the basic principle of the present invention, and FIG. 4 shows the additional signal generator 111 and compensation signal generator 114 in a first embodiment of the present invention.

The additional signal generator 111 is described first with reference to FIG. 3. The information contained in the sine signal-adding information 109 includes injected subband number information denoting to which synthesis filter bank the sine wave is injected, phase information denoting the phase at which the injected sinusoidal signal starts, timing information denoting the time at which the injected sinusoidal signal starts, and amplitude information denoting the amplitude of the injected sinusoidal signal.

Injected subband information extraction means 406 extracts the injected subband number. The phase information extraction means 402 determines, based on the phase information if phase information is contained in the sine signal-adding information 109, the phase at which the injected sinusoidal signal starts. If phase information is not contained in the sine signal-adding information 109, the phase information extraction means 402 determines the phase at which the injected sinusoidal signal starts with consideration for continuity to the phase of the previous time frame.

Amplitude extraction means 403 extracts the amplitude information. Timing extraction means 404 extracts the timing information indicating what time to start sine wave injection and what time to end injection when a sine wave is injected to the synthesis filter bank.

Based on the information from the phase information extraction means 402, amplitude extraction means 403, and timing extraction means 404, the sinusoid generating means 405 generates the sine wave (tone signal) to be injected. It should be noted that the frequency of the generated sine wave can be desirably set to, for example, the center frequency of the subband or a frequency offset a predetermined offset from the center frequency. Further, the frequency could be preset according to the subband number of the injected subband. For example, a sine wave of the upper or lower frequency limit of the subband could be generated according to whether the subband number is odd or even. It is assumed below that a sine wave with the center frequency of the subband is produced, i.e., a periodic signal with four subband signal sampling periods is produced.

The sine wave injection means 407 inserts the sine wave output by sinusoid generating means 405 to the synthesis filter subband matching the number acquired by the injected subband information extraction means 406. The output signal from sine wave injection means 407 is injection signal 112.

Figure 5B:
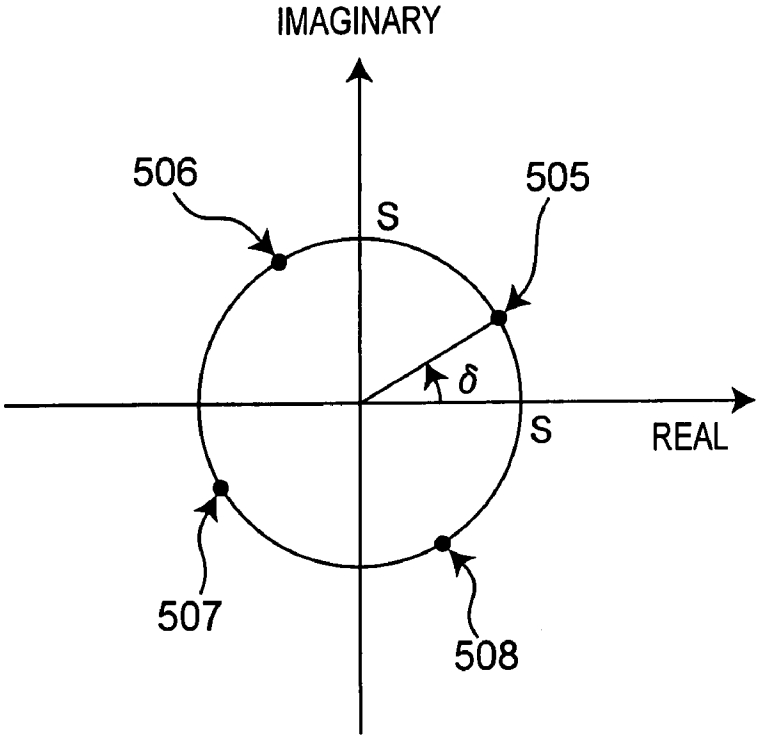
FIGS. 5A and 5B, each shows an example of an injected complex-value signal.
Figure 5A:
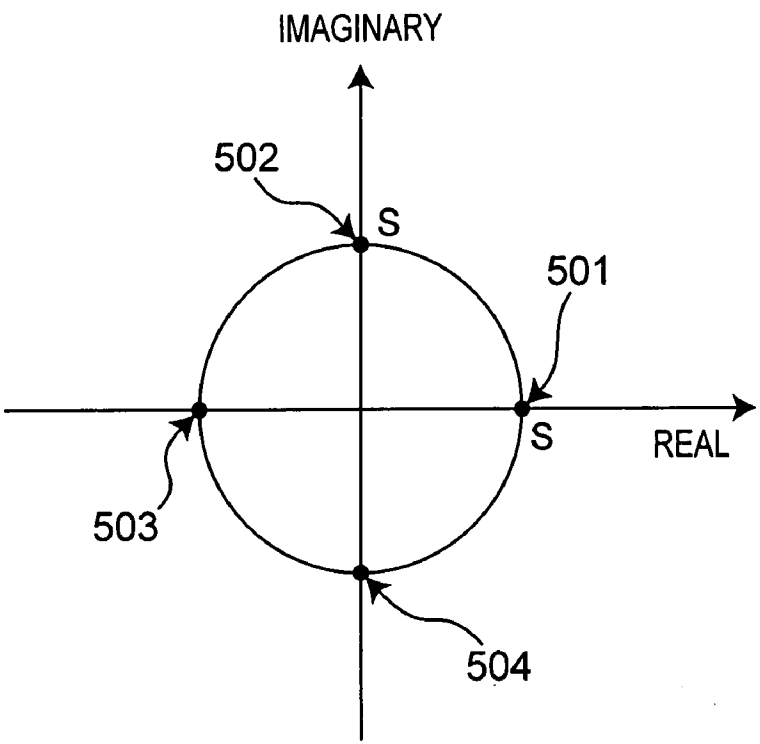

Consider a complex-valued signal with four periods and amplitude S injected to subband K as shown in the table in FIG. 6. The values denoted (a,b) in the table mean the complex-valued signal a+jb. where j is an imaginary value. Referring to FIG. 5A, the signal inserted to subband K in FIG. 6 is a periodic signal that changes 501, 502, 503, 504 in FIG. 5A due to the relationship between the real-value part and the imaginary value part.

Figure 9:
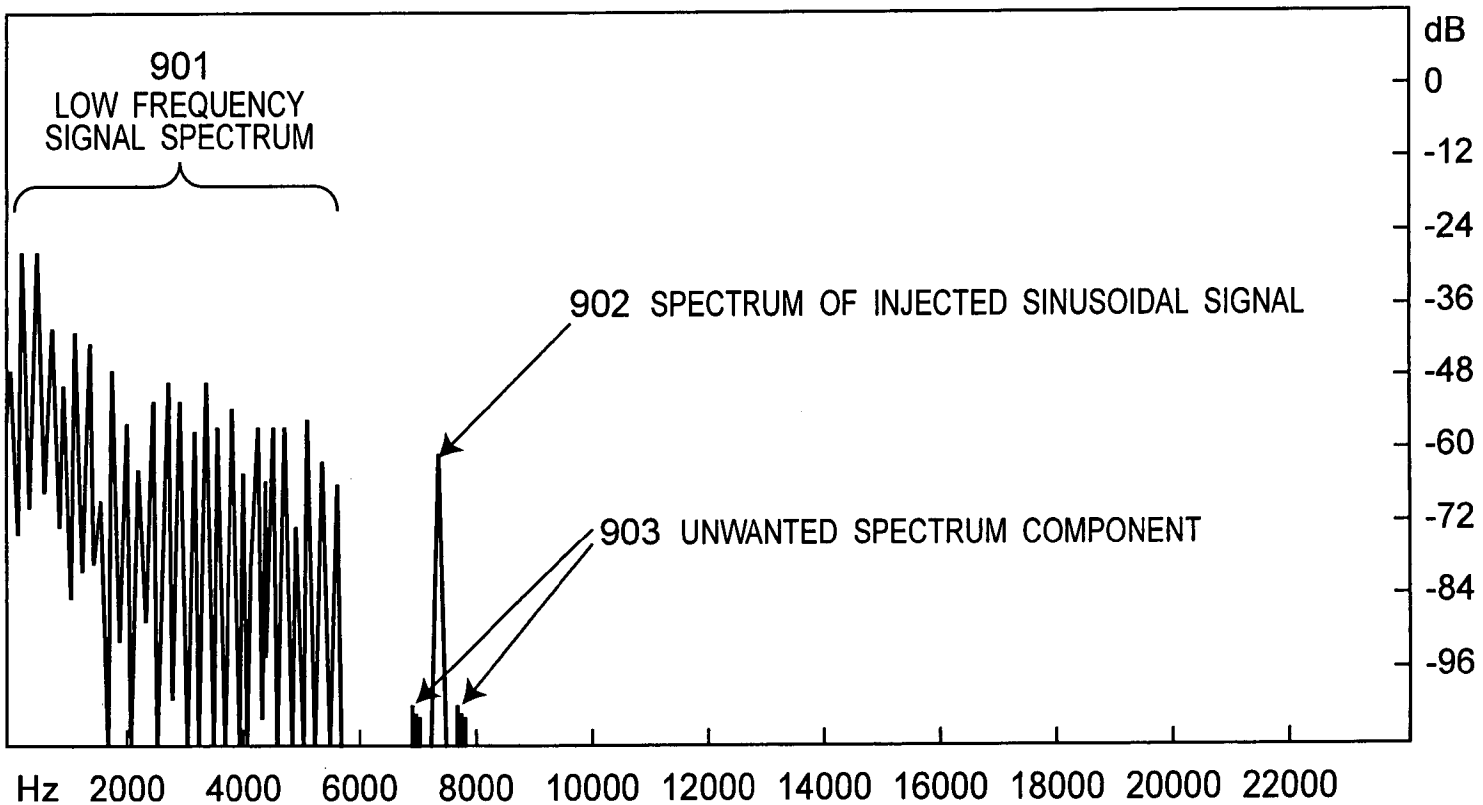
FIG. 9 is a spectrum diagram for when a sine wave for only the real-value part is injected to the real-value synthesis filter.

If, unlike in the present invention, the synthesis filter bank is a filter that takes complex-valued input and performs complex-valued calculations, the output signal of the decoding system obtained by this injection signal has a single frequency spectrum and a so-called pure sine wave is injected. However, if the synthesis filter bank is a filter that takes only real-value input and performs only real-value calculations as in the present invention, a real-number signal not containing the imaginary number part shown in FIG. 6 is injected to subband K as shown in FIG. 7. With this injection signal the decoding system using a synthesis filter that takes only real values outputs a single frequency spectrum as shown in FIG. 9 (spectrum 902 of the injected sine wave) and unwanted spectrums in the bands above and below the sine wave spectrum (unwanted spectrum 903). This is because a synthesis filter using real-valued calculation cannot completely eliminate spectrum leakage into adjacent subbands due to the filter characteristics, and these spectrum leaks appear as aliasing components.

By providing a compensation signal generator 114 as shown in FIG. 4 in addition to the additional signal generator 111 shown in FIG. 3 in a synthesis filter bank using real-valued calculation with only real value input, the unwanted spectrum components shown in FIG. 9 can be removed.

Additional signal generator 111 and compensation signal generator 114 according to the present invention are described next with reference to FIG. 4. In FIG. 4 the sine signal-adding information 109, phase information extraction means 402, amplitude extraction means 403, timing extraction means 404, sinusoid generating means 405, injected subband information extraction means 406, sine wave injection means 407, and injection signal 408 are the same as described with reference to FIG. 3. What differs from FIG. 3 is the addition of compensation subband information determining means 409 and compensation signal generator 410.

The compensation subband information determining means 409 determines the subband to be compensated based on the information obtained by the injected subband information extraction means 406 indicating the number of the synthesis filter bank to which the sine wave is injected. The subband to be compensated is a subband near the subband to which the sine wave is injected, and may be a high frequency subband or low frequency subband. The high frequency subband and low frequency subband to be compensated will vary according to the characteristics of the synthesis filter bank 105, but are here assumed to be the subbands adjacent to the subband of the injected sine wave. For example, when the sine wave is injected to subband K, subband K+1 and subband K−1 are, respectively, the high frequency subband and low frequency subband to be compensated.

The compensation signal generator 410 generates a signal cancelling aliasing spectra in the compensated subband based on the output of phase information extraction means 402, amplitude extraction means 403, and timing extraction means 404, and outputs this signal as compensation signal 113. This compensation signal 113 is added to the input signal to the synthesis filter bank 105 in the same way as injection signal 112. The amplitude S and phase of the compensation signal 113 are adjusted for subband K−1 and subband K+1 as shown in the table in FIG. B.

In FIG. 8 Alpha and Beta are values determined according to the characteristics of the specific synthesis filter bank, and more specifically are determined with consideration for the amount of spectrum leakage to adjacent subbands in the filter bank.

As will be known from FIG. 8, if a sinusoidal signal is added to subband K, the amplitude of a sinusoidal signal of cycle period T is amplitude S at time 0, amplitude 0 at time 1T/4, amplitude −S at time 2T/4, and amplitude 0 at time 3T/4. A compensation signal is applied to subband K−1 and subband K+1. In the drawings, TIMEs 0, 1, 2 and 3 correspond to times 0, 1T/4, 2T/4 and 3T/4, respectively.

The compensation signal applied to subband K−1 has amplitude 0 at time 0, amplitude Alpha*S at time 1T/4, amplitude 0 at time 2T/4, and amplitude Beta*S at time 3T/4.

The compensation signal applied to subband K+1 has amplitude 0 at time 0, amplitude Beta*S at time 1T/4, amplitude 0 at time 2T/4, and amplitude Alpha*S at time 3T/4.

Figure 10:
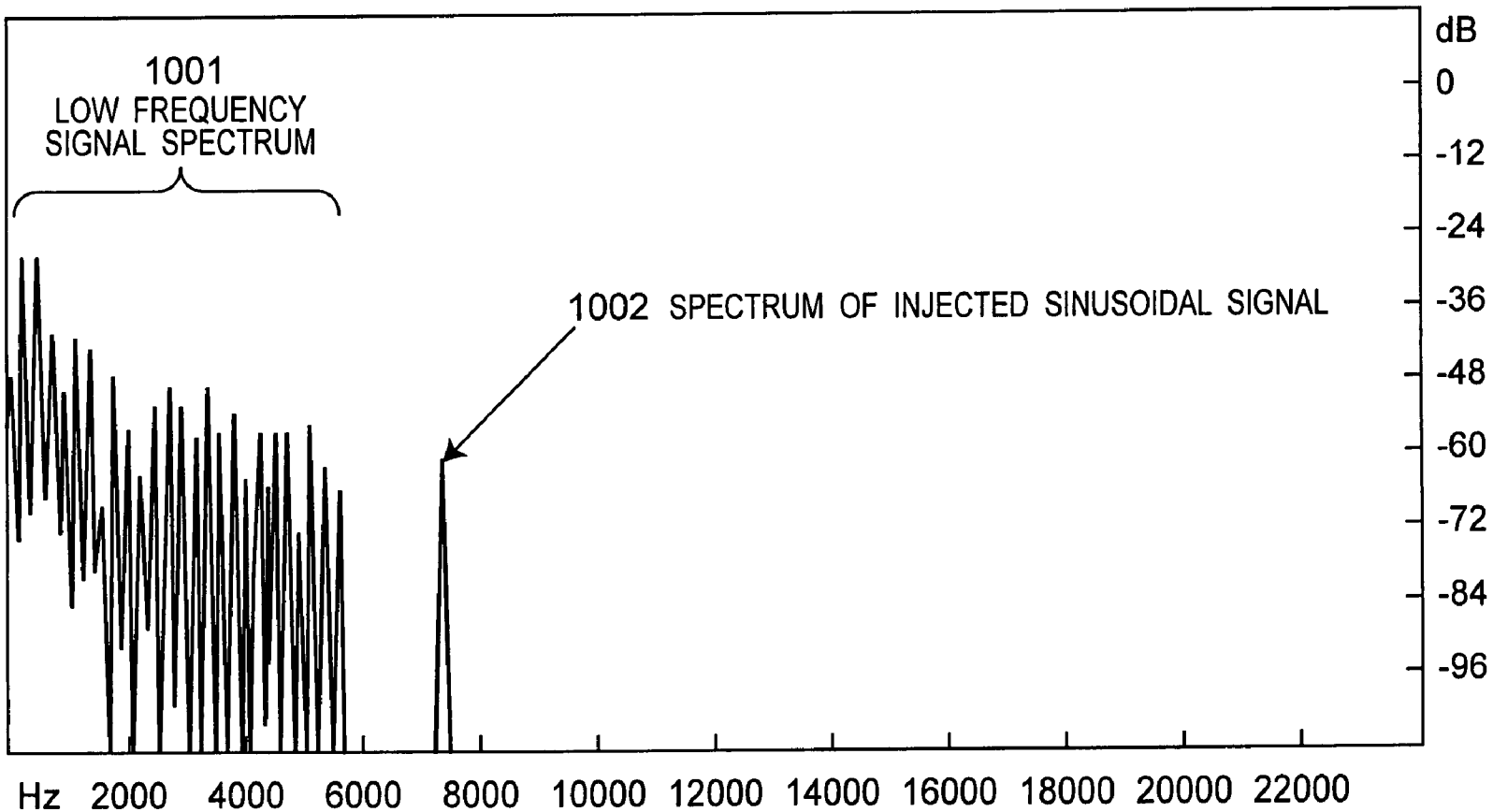
FIG. 10 is a spectrum diagram for when a sine wave for only the real-value part and a compensation signal are injected to the real-value synthesis filter.

FIG. 10 is a spectrum graph for the sine wave injected by a preferred embodiment of this invention. As will be known from FIG. 10, the unwanted spectrum component 903 observed in FIG. 9 is suppressed.

By introducing this compensation signal, unwanted spectrum components are not produced even if a sinusoidal signal is injected to a real-value filter bank, and a sine wave can be injected to a desired subband with minimal calculations.

The invention has been described with reference to a sinusoidal signal injected to subband K where the initial phase is 0 and either the real-value part or imaginary-value part goes to 0 as shown in FIG. 5A. As shown in FIG. 5B, however, the present invention can also be applied when the phase is shifted δ from the state shown in FIG. 5A. The relationship between the injection signal and compensation signal in this case can be expressed as shown in the table in FIG. 11, for example, where S, P, and Q are values determined according to the characteristics of the filter bank with consideration for the amount of spectrum leakage by the filter bank to adjacent subbands.

Furthermore, for a subband K to which the sine wave is injected a compensation signal is injected to adjacent subbands K−1 and K+1, but adjacent subbands other than K−1 and K+1 may need correction depending on the characteristics of the synthesis filter. In this case the compensation signal is simply injected to the subbands that need correction.

(Embodiment 2)

Figure 12:
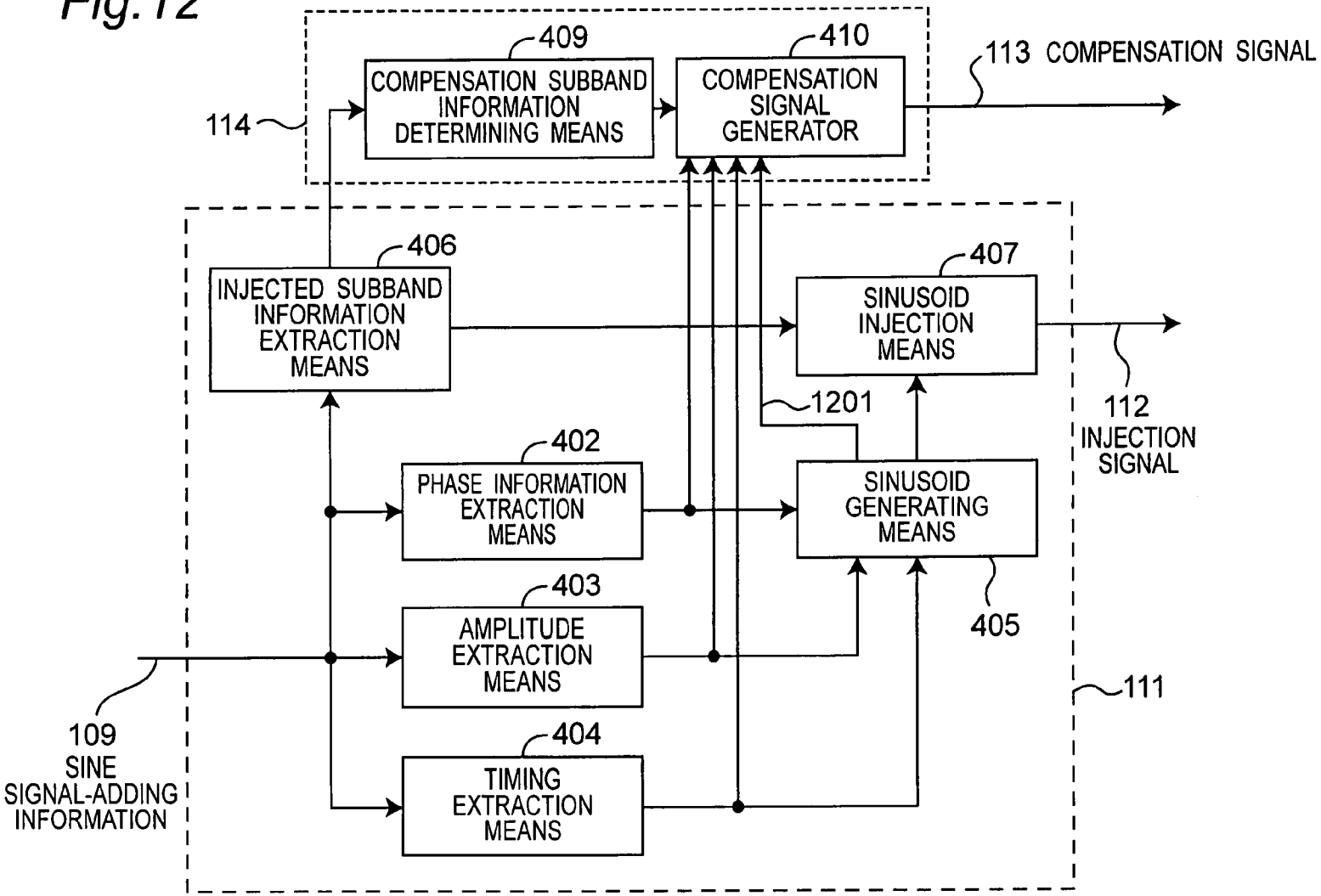
FIG. 12 shows an example of the additional signal generator in a second embodiment of the present invention.

FIG. 12 is a schematic diagram showing an additional signal generator in a second embodiment of the present invention. This additional signal generator differs from the additional signal generator, 111 shown in FIG. 4 in that interpolated information 1201 calculated by the sinusoid generating means 405 is input to compensation signal generator 410 so that the compensation signal 113 is calculated based on the interpolated information 1201.

The sinusoid generating means 405 in the above first embodiment adjusts the amplitude of the generated sine wave based only on the amplitude information of the current frame extracted by the amplitude extraction means 403. The sinusoid generating means 405 of this second embodiment, however, interpolates the amplitude information using amplitude information from neighboring frames, and adjusts the amplitude of the generated sine wave based on this interpolated amplitude information.

Because the amplitude of the generated sine wave changes smoothly as a result of this process, the observed sound quality of the output signal can be improved.

Because the amplitude of the generated sine wave is changed by interpolation with this configuration, the amplitude of the corresponding compensation signal must also be adjusted. Therefore, the interpolated information output by the sinusoid generating means 405 is also input to the compensation signal generator 410 to adjust the amplitude of the compensation signal 113 synchronized to the interpolated variable amplitude of the sine wave.

This configuration of the invention can correctly calculate the compensation signal and suppress unwanted spectrum components even when the amplitude of the generated sine wave is interpolated.

It will also be apparent that the process of the audio decoding apparatus shown in FIG. 1 can also be written in software using a programming language. In addition, this software program can be recorded to and distributed by a data recording medium.

When using a synthesis filter bank that reduces the number of operations by using only real-valued calculations, unwanted spectrum components accompanying sine wave addition can be suppressed and only the desired sine wave can be injected by injecting a compensation signal to the low frequency or high frequency subband of the subband to which the sine wave is added.

We claim:

1. An audio decoding apparatus for decoding an audio signal from a bitstream containing encoded information about a narrowband audio signal and additional information for expanding the narrowband audio signal to a wideband audio signal, the additional information containing high frequency component information denoting a feature of a frequency band higher than a frequency band of the encoded information narrowband audio signal, and sinusoid-adding information denoting a sinusoidal signal added to a specific frequency band, said audio decoding apparatus comprising:

a bitstream demultiplexer operable to demultiplex the encoded information and the additional information from the bitstream;

a decoder operable to decode the narrowband audio signal from the demultiplexed encoded information;

an analysis subband filter operable to separate the decoded narrowband audio signal into a first subband signal composed of a plurality of subband signals;

a sinusoidal signal generator operable to generate a sinusoidal signal added to a specific subband at a frequency band higher than a frequency band of the encoded information of the narrowband audio signal based on the sinusoid-adding information in the demultiplexed additional information;

a correction signal generator operable to generate, based on a phase characteristic and an amplitude characteristic of the sinusoidal signal, a correction signal added to subbands near a specific subband to suppress aliasing component signals occurring in the subbands near the specific subband;

a high frequency signal generator operable to generate a second subband signal composed of a plurality of subband signals in a frequency band higher than the frequency band of the encoded information of the narrowband audio signal from the first subband signal and high frequency component information in the demultiplexed additional information, and operable to add the sinusoidal signal and correction signal to the second subband signal; and a real-valued calculation subband synthesis filter operable to combine the first subband signal and the second subband signal to obtain the wideband audio signal.

2. An audio decoding apparatus according to claim 1, wherein the aliasing component signals contain at least components suppressed after synthesis by a subband synthesis filter that performs complex-valued calculations.

3. An audio decoding apparatus according to claim 1, wherein the first subband signal is composed of low frequency subband signals, and the second subband signal is composed of high frequency subband signals.

4. An audio decoding apparatus according to claim 1, wherein the correction signal generated by the correction signal generator suppresses aliasing component signals produced in a subband adjacent to the subband to which the sinusoidal signal is added.

5. An audio decoding apparatus according to claim 4, wherein when the sinusoidal signal is added to subband K, a sinusoidal signal of period T has amplitude S at time 0 amplitude 0 at time 1T/4, amplitude −S at time 2T/4, and amplitude 0 at time 3T/4, and correction signals are applied to subband K−1 and subband K+1;

the correction signal applied to subband K−1 has amplitude 0 at time 0, amplitude Alpha*S at time 1T/4, amplitude 0 at time 2T/4, and amplitude Beta*S at time 3T/4; and the correction signal applied to subband K+1 has amplitude 0 at time 0, amplitude Beta*S at time 1T/4, amplitude 0 at time 2T/4, and amplitude Alpha*S at time 3T/4;

where Alpha and Beta are constants.

6. An audio decoding apparatus according to claim 1, wherein an amplitude of the correction signal generated by the correction signal generator is synchronously adjusted to the amplitude characteristic of the sinusoidal signal.

7. An audio decoding method for decoding an audio signal from a bitstream containing encoded information about a narrowband audio signal and additional information for expanding the narrowband audio signal to a wideband audio signal, and the additional information containing high frequency component information denoting a feature of a frequency band higher than a frequency band of the encoded information of the narrowband audio signal, and sinusoid-adding information denoting a sinusoidal signal added to a specific frequency band, said audio decoding method comprising:

demultiplexing the encoded information and the additional information from the bitstream;

decoding the narrowband audio signal from the demultiplexed encoded information;

separating the decoded narrowband audio signal into a first subband signal composed of a plurality of subband signals;

generating a sinusoidal signal added to a specific subband at a frequency band higher than a frequency band of the encoded information of the narrowband audio signal based on the sinusoid-adding information in the demultiplexed additional information;

generating, based on a phase characteristic and an amplitude characteristic of the sinusoidal signal, a correction signal added to subbands near a specific subband to suppress aliasing component signals occurring in the subbands near the specific subband;

generating a second subband signal composed of a plurality of subband signals in a frequency band higher than the frequency band of the encoded information of the narrowband audio signal from the first subband signal and high frequency component information in the demultiplexed additional information, and adding the sinusoidal signal and correction signal to the second subband signal; and synthesizing the first subband signal and the second subband signal using a real-valued calculation to obtain the wideband audio signal.

8. An audio decoding method according to claim 7, wherein the aliasing component signals contain at least components suppressed after synthesis performed using complex-valued calculations.

9. An audio decoding method according to claim 7, wherein the first subband signal is composed of low frequency subband signals, and the second subband signal is composed of high frequency subband signals.

10. An audio decoding method according to claim 7, wherein the generated correction signal suppresses aliasing component signals produced in a subband adjacent to the subband to which the sinusoidal signal is added.

11. An audio decoding method according to claim 10, wherein when the sinusoidal signal is added to subband K, a sinusoidal signal of period T has amplitude S at time 0, amplitude 0 at time 1T/4, amplitude −S at time 2T/4, and amplitude 0 at time 3T/4, and correction signals are applied to subband K−1 and subband K+1;

the correction signal applied to subband K−1 has amplitude 0 at time 0, amplitude Alpha*S at time 1T/4, amplitude 0 at time 2T/4, and amplitude Beta*S at time 3T/4; and the correction signal applied to subband K+1 has amplitude 0 at time 0, amplitude Beta*S at time 1T/4, amplitude 0 at time 2T/4, and amplitude Alpha*S at time 3T/4;

where Alpha and Beta are constants.

12. An audio decoding method according to claim 7, wherein an amplitude of the generated correction signal is synchronously adjusted to the amplitude characteristic of the sinusoidal signal.

13. A computer-readable medium having stored thereon a program comprising computer executable code operable to cause a computer to perform the audio decoding method claimed in claim 7.

* * * * *

UNITED STATES PATENT AND TRADEMARK OFFICE

CERTIFICATE OF CORRECTION

PATENT NO. : 7,058,571 B2
APPLICATION NO. : 10/491894
DATED : June 6, 2006
INVENTOR(S) : Mineo Tsushima et al.

It is certified that error appears in the above-identified patent and that said Letters Patent is hereby corrected as shown below:

Column 9,

Line 49, "information narrowband" should read --information of the narrowband--.

Signed and Sealed this

Thirteenth Day of March, 2007

JON W. DUDAS
*Director of the United States Patent and Trademark Office*